US005203570A

United States Patent [19]

Graham

[11] Patent Number: 5,203,570

[45] Date of Patent: Apr. 20, 1993

[54] GOLF SWING TRAINING APPARATUS

[76] Inventor: John Graham, 210 5th St., Queensbury, N.Y. 12804

[21] Appl. No.: 911,509

[22] Filed: Jul. 10, 1992

[51] Int. Cl.[5] ..... A63B 69/36

[52] U.S. Cl. ..... 273/187.2; 273/189 R

[58] Field of Search ..... 273/187.2, 189 R, 189 A, 273/188 R, 183.1

[56] References Cited

U.S. PATENT DOCUMENTS

| | | | |
|---|---|---|---|
| 475,432 | 5/1892 | Blades | 273/189 R X |
| 3,415,524 | 12/1968 | Vickers | 273/189 R |
| 3,679,214 | 7/1972 | Boyte | 273/189 R |
| 4,940,237 | 7/1990 | Mortensen | 273/189 R |
| 5,154,416 | 10/1992 | Smull | 273/187.2 X |

*Primary Examiner*—George J. Marlo
*Attorney, Agent, or Firm*—E. Michael Combs

[57] ABSTRACT

A golf swing training apparatus used as a practice and learning device for perfecting the swinging movements of golf clubs is disclosed. The apparatus is comprised of a continuous elastomeric band having a large loop on one end for placement around a leading arm and over the shoulder of the golfer. The elastomeric band has a pair of substantially parallel legs extending from the large loop. The legs are positioned across the golfer's back and along the rear (elbow) side of his trailing or power arm. A pair of arm loops are attached to the legs at longitudinally spaced positions therealong for receiving the trailing arm, while a glove is attached to the ends of the legs to receive the hand of the trailing arm. Rigid or semi-rigid support bars and quantitative measuring means may be mounted on the legs to further assure arm straightness and to indicate any angular deflection which may occur between the upper and lower portions of the trailing arm, respectively.

12 Claims, 4 Drawing Sheets

GOLF SWING TRAINING APPARATUS

BACKGROUND OF THE INVENTION

1. Field of the Invention

The field of the invention relates to game practice and learning devices, and more particularly to golf swing training apparatuses which are configured to be physically mounted on a practicing golfer's body to provide indications to the golfer as to whether or not correct swinging movements of the club are being performed to effectively drive the ball along a straight and accurate travel path.

2. Description of the Prior Art

The game of golf continues to be a universally practiced and popular sport. It is also universally recognized by both professional and amateur participants, however, that golfing is one of the most difficult games to perfect. More particularly, the most critical aspect of the game is the performance of a proper swinging movement of the club to drive the ball along a straight travel path for a required distance. In the past, many practice and learning devices have been used to assist the practicing golfer in improving his or her performance. Such devices include physical restraining equipment which can be attached to the clubs or to the golfer, or both. Further, additional physical training aids external to both the golfer and the clubs are also available, as well as teaching professionals ( i.e. golf "pros"), driving ranges, instructional video tapes, etc.

A wide variety of golf practice and learning devices have been utilized in the prior art. For example, U.S. Pat. No. 4,147,356 to Brandell sets forth a golf swing practice device for preventing undesirable swaying during a back swing comprising a downwardly sloping rest for the golfer's back foot, and a back member extending upwardly from the foot rest which presses against the golfer's leg when excessive body sway occurs during his back swing, thus serving as both a reminder of objectional body sway as well as means for preventing it.

U.S. Pat. No. 4,155,555 to Fink discloses a golf swing practice apparatus for quantitatively measuring the velocity, face angle, travel path, and deviation from the "sweet spot" of a golf club during both putting and full swing strokes. The apparatus includes visual displaying means for the various measurements calculated from signals received from sensors arranged along the travel path of the club, as well as means for indicating whether the club is swung within acceptable ranges of the measured parameters.

U.S. Pat. No. 4,743,028 to Harrison illustrates a further golf swing practice device comprising a body contoured to the shape of the golfer's arm. The device is positioned on the upper portion of the golfer's "power" (i.e. trailing) arm and held thereon by a strap. The body is formed in two parts which are moveable relative to each other. In use, the device is pressed between the golfer's arm and upper body so that any separation of his arm and body during a swing causes separation of the device's body parts which is sensed and indicated by activation of a buzzer or other indicator within the device.

U.S. Pat. No. 4,944,518 to Flynn shows another golf swing practice apparatus which comprises an elastic band attachable to a golf club at one end and a fixed support at the opposite end. Movement of the club stretches and tensions the band and simulates the end of the down swing and the follow through portions of a golf swing. Accordingly, the golfer stretches the band through varying distances to hone his timing and balance, and to exercise and strengthen his wrist, arm, and shoulder muscles.

U.S. Pat. No. 4,922,933 to Awazu et al discloses still another golf swing practice device including a calibrated elongate member positionable on the ground adjacent to a golf ball. The elongate member has Tee and guide members adjustably mounted thereon to provide precise spaced guide means for swinging a selected golf club in a proper trajectory for driving the ball along a straight path for either long, intermediate, or putting distances.

As such, it may be appreciated that there continues to be a need for a new and improved golf swing training apparatus which addresses both the problems of ease of use, portability, and effectiveness in construction, and in this respect, the present invention fulfills this need.

SUMMARY OF THE INVENTION

In view of the foregoing disadvantages inherent in the known types of game practice and learning devices now present in the prior art, the present invention provides a golf swing training apparatus which is constructed to be easily and comfortably mounted on a practicing golfer's body to provide a simple and accurate indicator to the golfer to assist him or her in performing a correct swinging movement of the club to more effectively drive the ball along a straight and accurate travel path. As such, the general purpose of the present invention, which will be described subsequently in greater detail, is to provide a new and improved golf swing training apparatus which has all the advantages of the prior art game practice and learning devices and none of the disadvantages.

To attain this, the present invention includes a golf swing training apparatus utilized as a practice and learning device for perfecting the swinging movement of golf clubs is set forth. The apparatus is comprised of a continuous elastic band having a large loop at one end for placement around the upper end of one arm and over the adjacent shoulder of the golfer. The elastic band has a pair of substantially parallel legs extending from the large loop which are positionable across the golfer's back and along the rear (elbow) side of his opposite arm which provides the power to drive the ball. A pair of arm loops are attached to the parallel legs at longitudinally spaced locations therealong for receiving the golfer's driving arm, while a glove is attached to the ends of the legs to receive his driving hand. Support bars and quantitative measuring means are also mounted on the legs to assure arm straightness and to indicate any angular deflection between the upper and lower portions of the driving arm, respectively.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the included abstract is to enable the U.S. Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The abstract is neither intended to define the invention of the application, which is measured by the claims, nor is it intended to be limiting as to the scope of the invention in any way.

It is therefore an object of the invention to provide a new and improved golf swing training apparatus which has all the advantages of the prior art game practice and learning devices and none of the disadvantages.

It is another object of the present invention to provide a new and improved golf swing training apparatus which may be easily and efficiently manufactured and marketed.

It is a further object of the present invention to provide a new and improved golf swing training apparatus which is of durable and reliable construction.

An even further object of the present invention is to provide a new and improved golf swing training apparatus which is susceptible of a low cost of manufacture with regard to both materials and labor, and which accordingly is then susceptible of low prices of sale to the consuming public, thereby making such golf swing training apparatuses economically available to the buying public.

Still yet another object of the present invention is to provide a new and improved golf swing training apparatus which provides in the apparatuses and methods of the prior art some of the advantages thereof, while simultaneously overcoming some of the disadvantages normally associated therewith.

Still another object of the present invention is to provide a new and improved golf swing training apparatus comprising a simple learning device which is more effective in perfecting a driving swing as opposed to using the inefficient and imprecise trial and error process of repeated unassisted swings.

Yet another object of the present invention is to provide a new and improved golf swing apparatus which provides arm straightening assistance as well as a quantitative measuring means of driving arm straightness during a swing to more easily and efficiently determine the proper arm swing to drive the ball accurately the desired distance.

Even still another object of the present invention is to provide a golf swing training apparatus which is easily and comfortably mounted on the golfer's body, and readily conformable to the shape of the golfer's body both at rest and during the driving swing.

Still another object of the present invention is to provide a golf swing training apparatus which is readily transportable and usable in any desired practice location such as indoors or outdoors at home, on a golf course, or at a driving range.

Yet still another object of the present invention is to provide a golf swing training apparatus which is readily useable by either right or left handed golfers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figures 1, 1A:
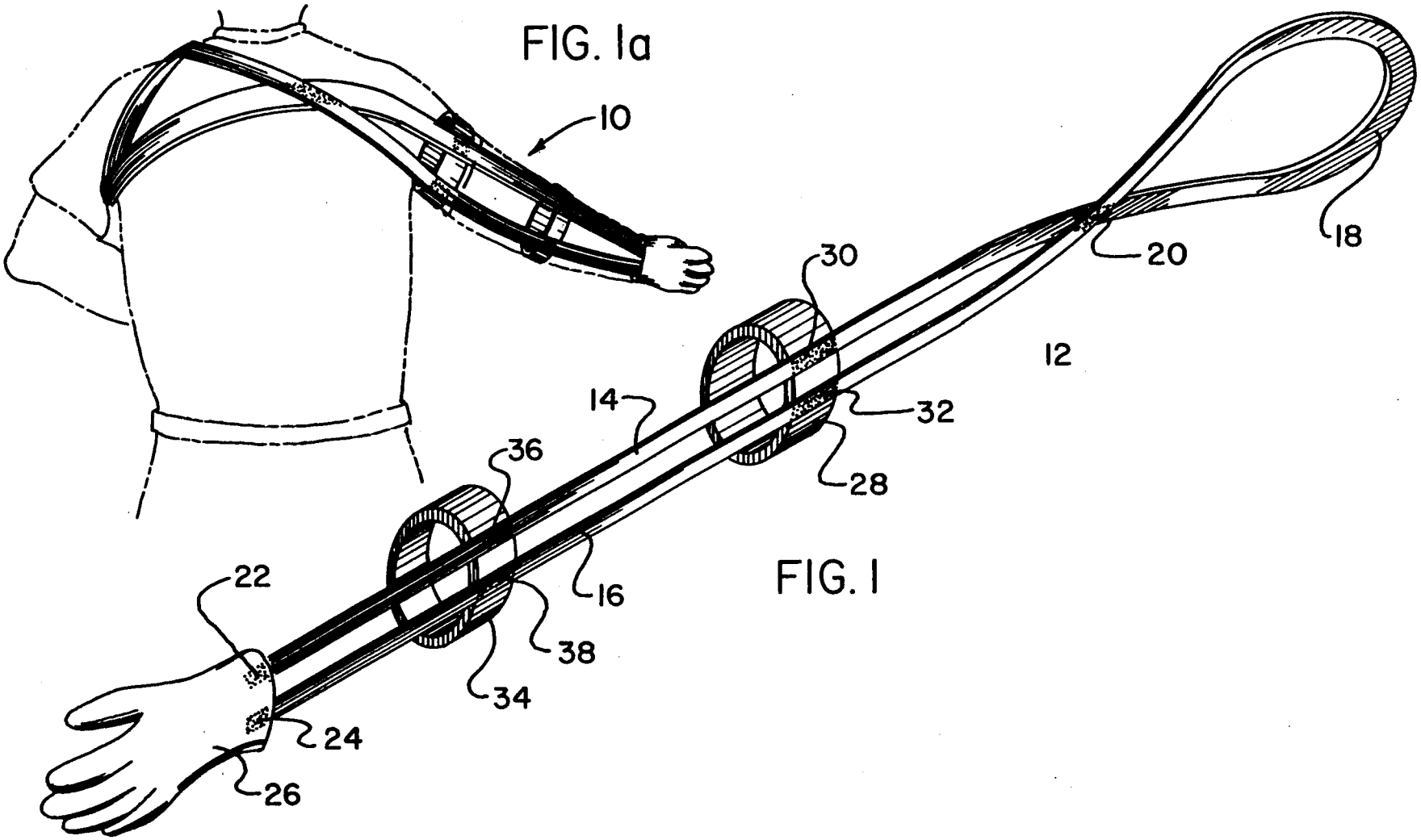
FIG. 1 is a perspective view of a first embodiment of the present invention.
FIG. 1*a* is a rear view of a golfer illustrating the first embodiment of the present invention mounted on the golfer's body.

With reference now to the drawings, and in particular to FIGS. 1–4 thereof, a new and improved golf swing training apparatus embodying the principles and concepts of the present invention and generally designated by the reference numerals 10, 39, and 67 will be described.

More specifically, and with particular reference to FIGS. 1 and 1*a*, a golf swing training apparatus 10 of a first embodiment of the invention essentially comprises a continuous band 12 of elastomeric fabric material. An intermediate portion of band 12 is formed as an enlarged and closed shoulder loop 18 which is dimensioned to fit under a leading arm and over the shoulder of the golfer as shown in FIG. 1*a*. Loop 18 is formed and closed at a joining point 20 wherein opposed end points of said intermediate portion of band 12 may be bonded adhesively, sewn together, or fixed together using conventional mechanical fasteners. Extending from joining point 20 of shoulder loop 18 are end portions of band 12 which are configured as a pair of substantially parallel legs 14,16 which terminate at the opposed ends 22,24, respectively, of band 12. Attached to band 12 and leg ends 22,24 is a glove 26 which receives the hand of the golfer's trailing or power arm. The attachment of glove 26 to band 12 and leg ends 22,24 may also be effected adhesively, by sewing or mechanical fastening. Positioned at longitudinally spaced points along legs 14,16 are a pair of annular, arm-receiving loops 28,34. Arm loop 28 is attached to legs 14,16 at joining points 30,32, respectively while arm loop 34 is attached to legs 14,16 at joining points 36,38, respectively. Joining of arm loops 28,34 to legs 14,16 may also be effected adhesively, by sewing or mechanical fastening. The longitudinal spacing of arm loops 28,34 on legs 14,16, as well as the parallel spacing of the legs, is such that the elbow of the golfer's trailing arm can be positioned approximately midway between the loops 28,34 and the legs 14,16 as indicated by the circle in FIG. 1*a*.

In use, the practicing golfer positions a trailing (either the right or left) arm through arm loops 28,34 and slides his hand into glove 26. The golfer then places his opposite (leading) arm through shoulder loop 18. With both arms inserted into the apparatus as described, the golfer raises his arms and flips the apparatus over his head and onto his back in a movement analogous to putting on a pullover sweater. In this manner, shoulder loop 18 is positioned around the upper part of said leading arm (at the arm pit), over an adjacent shoulder, and across the back. A portion of legs 14,16 lies against the back, while the remaining portion of said legs rests against the back of said trailing arm. The positions of legs 14,16 are then adjusted so that the elbow is centrally positioned in the manner described in the preceding paragraph. The apparatus is then in the ready position shown in FIG. 1*a*. During a practice swing, as the club is brought downwardly toward the ball following the rear and upward portion of the swing, the tension in band 12 increases which serves as a teaching reminder to the golfer to maintain his arms straight to drive the ball in an accurate manner as the club approaches and strikes the ball. After the club is swung through the ball striking position, it is moved arcuately upwardly away from the ball striking position and into the follow through portion of the swing with the arms remaining straight. After the follow through portion, the club continues upwardly into the forward or end portion of the swing wherein the tension in the band is released, allowing the arms to bend freely to complete the swing.

Figure 2:
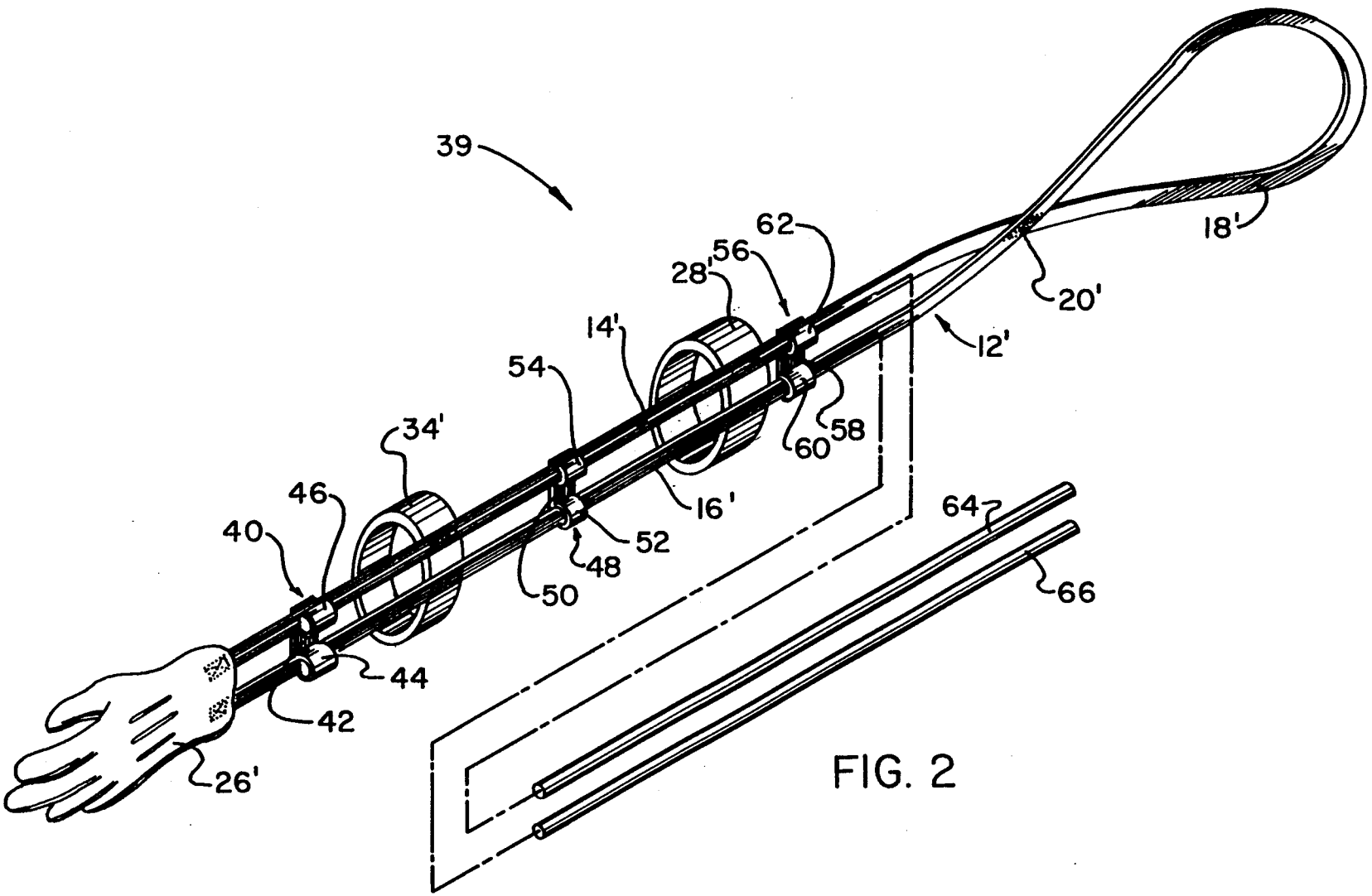
FIG. 2 is a perspective view, partly in an exploded illustration, of a second embodiment of the present invention.

Referring now to FIG. 2, a golf swing training apparatus 39 of a second embodiment of the invention comprises a structure which is substantially similar to that of the first embodiment. Those elements which are identical to those of apparatus 10 are indicated by a single prime(') next to their numbers. Additionally, apparatus 39 is provided with structural means mounted on legs 14',16' to assure, in combination with the reminder provided by increased strap tension, that the golfer's arms are maintained straight during the approach, ball striking, and follow through portions of the swing. More specifically, a series of support bar mounting means 40,48, and 56 are attached to legs 14',16' at positions spaced longitudinally along said legs using adhesives or suitable fasteners (not shown). First support bar mounting means 40 is positioned between glove 26' and arm loop 34' and comprises a base element 42 on one side of legs 14',16', and a pair of opposed mounting bosses 44,46 positioned on the opposite side of said legs, wherein each mounting boss 44,46 is positioned adjacent to a respective end of the base element 42. Each of the mounting bosses 44,46 is provided with a central blind bore (not shown) which is parallel to a respective leg 14',16'. Second support bar mounting means 48 is positioned approximately centrally between arm loop 34' and arm loop 28' and includes a base element 50 on one side of legs 14',16', and a pair of opposed U-shaped mounting clips 52,54 positioned on the opposite side of said legs, wherein each clip 52,54 is positioned adjacent to a respective end of the base element 50. The opening of each clip 52,54 is longitudinally aligned with the central blind bores of mounting bosses 44,46, respectively. Third support bar mounting means 56 is positioned between arm loop 28' and joining point 20' at a location adjacent to arm loop 28' and includes a base element 58 on one side of the legs 14',16', and a pair of U-shaped mounting clips 60,62 positioned on the opposite side of said legs, wherein each clip 60,62 is positioned adjacent to a respective end of the base element 58. The opening of each clip 60,62 is longitudinally aligned with the opening of each clip 52,54 and the blind bores of mounting bosses 44,46, respectively. A support bar 64 has one end inserted completely into the blind bore of mounting boss 46, said support bar extending along leg 14', through U-shaped clip 54, and through U-shaped clip 62 to an opposite end a short distance beyond clip 62. Similarly, a support bar 66 has one end inserted completely into the blind bore of mounting boss 44, said support bar extending along leg 16', through U-shaped clip 52, and through U-shaped clip 60 to an opposite end a short distance beyond clip 60. . . Support bars 64,66 are provided with a diameter slightly smaller than the diameter of the blind holes in mounting bosses 44,46 and the openings of U-shaped clips 52,54,60,62 to insure a snug fit therein, and thus provide a secure assembly on the legs 14',16'. At the same time, the smaller diameter of the support bars also permits their easy sliding removal from mounting bosses 44,46 and U-shaped clips 52,54,60,62 by gripping and pulling on the ends of the support bars 64,66 which extend beyond U-shaped clips 62, 60, respectively, for their replacement or use of the apparatus without them. Support bars 66,66 may either be semi-rigid and constructed of a polymeric material for example, or rigid and constructed of a light weight metal such as aluminum.

In use, apparatus 39 is placed on the golfer's body in the same manner as apparatus 10 of the first embodiment. During a practice swing, and particularly during the approach, ball striking, and follow through portions thereof, the increased tension in strap 12' provides a teaching reminder to the golfer to maintain both of his arms straight. At the same time, the support bars 64,66 also impose a physical restraint against bending of the trailing or power arm, thus providing further assistance in maintaining a condition of straightness in the trailing arm, while providing a second teaching reminder to similarly keep the leading arm in the same straight condition as the trailing arm.

Figure 3:
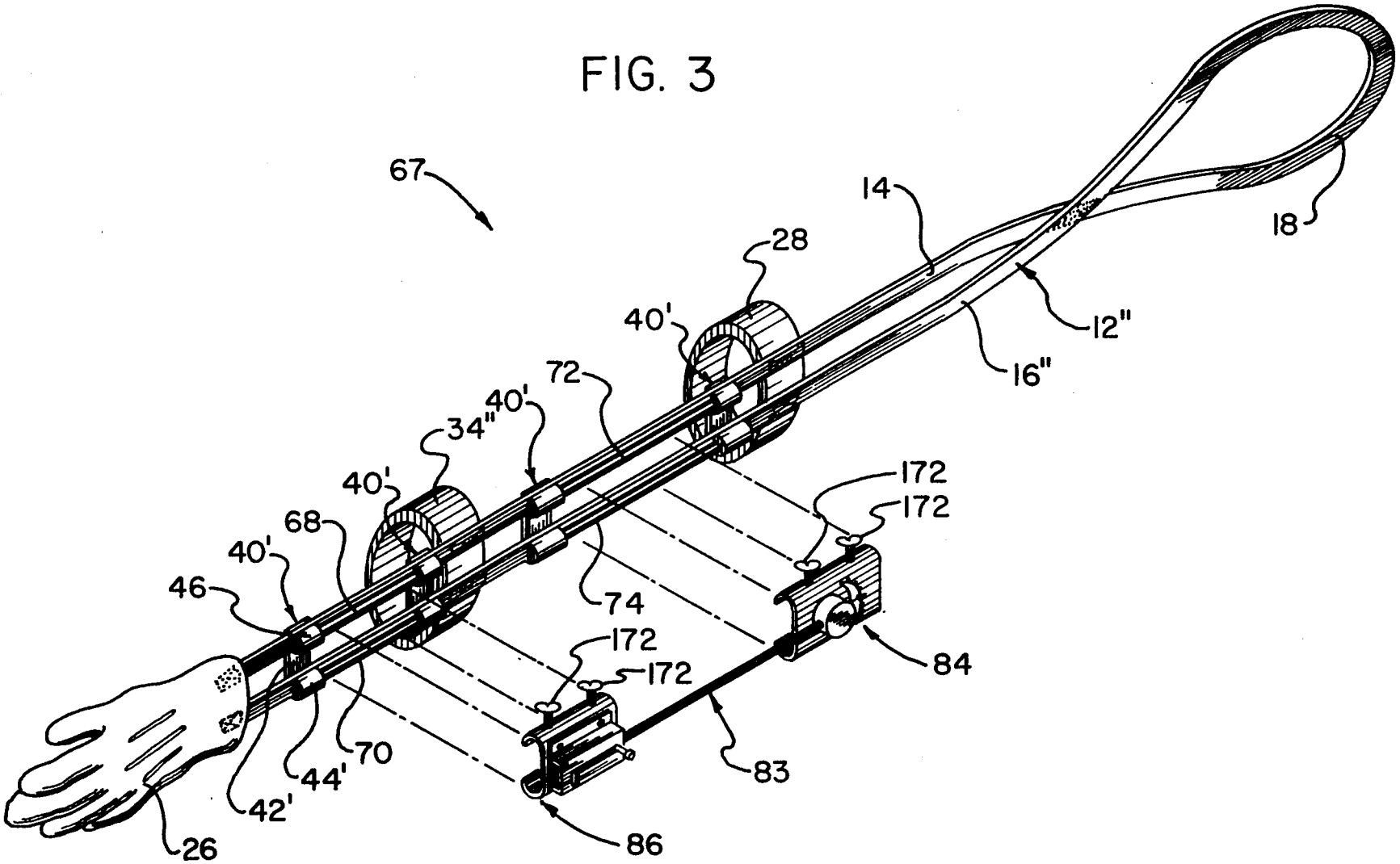
FIG. 3 is a perspective view, partly in an exploded illustration, of a third embodiment of the present invention.
Figure 4:
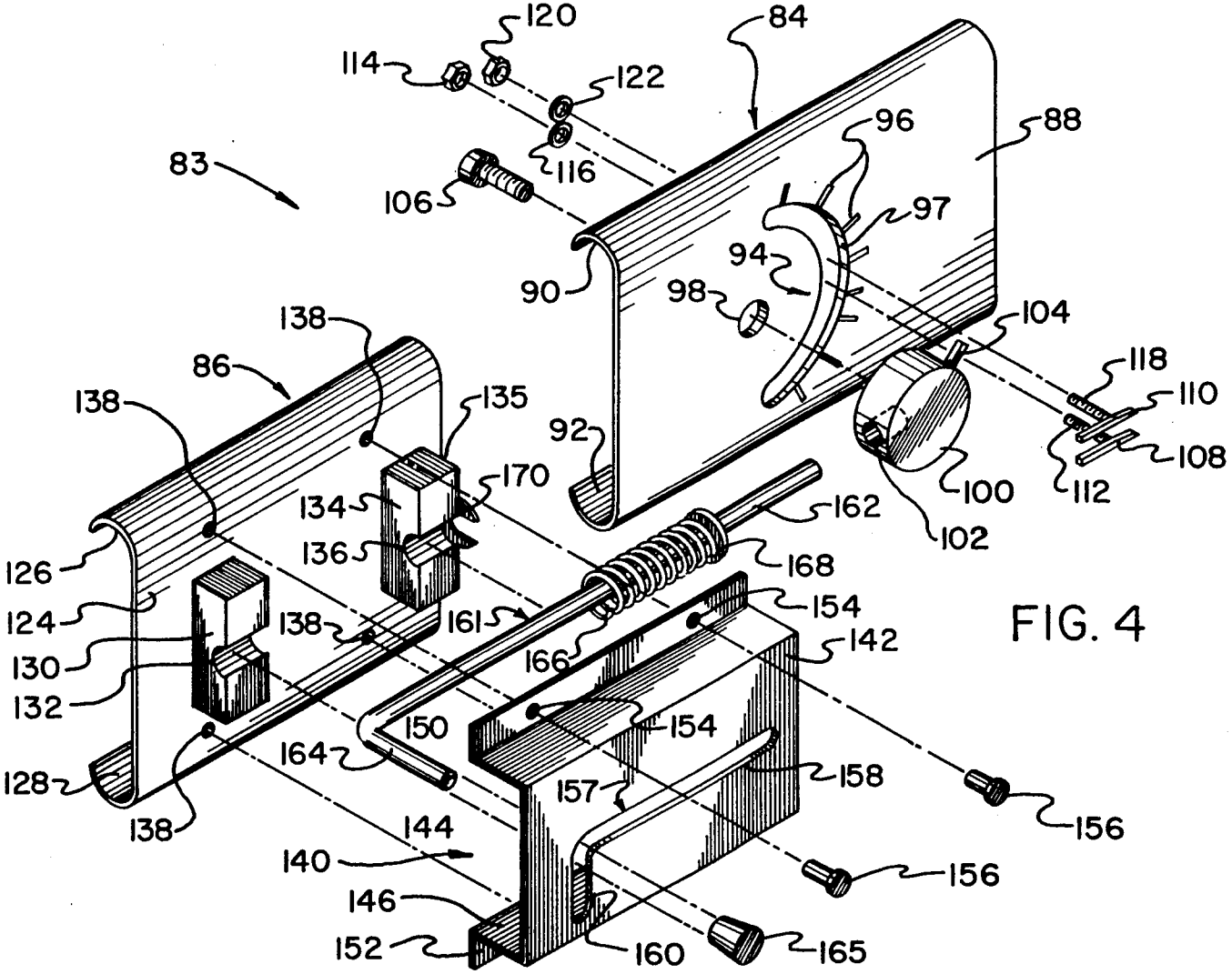
FIG. 4 is a more detailed perspective view, in exploded illustration, of the angle of deflection measuring means of the third embodiment of the present invention shown in FIG. 3.

With reference to FIGS. 3 and 4 of the drawings, a golf swing training apparatus 67 of a third embodiment of the invention comprises a structure which is substantially similar to that of both the first and second embodiments. Those elements which are identical to those of apparatus 10 are indicated by a double prime(''), while those elements which are identical to those of apparatus 39 are indicated by a single prime(') next to their numbers. Furthermore, apparatus 67 is also provided with a quantitative measuring means to measure any angle of deflection which may occur between the upper and lower portions of the golfer's trailing or power arm during the approach, ball striking, or follow through portions of the swing. A series of support bar mounting means 40' are attached to legs 14'',16''. A first pair of support bar mounting means 40' are spaced along legs 14'',16'' between glove 26'' and arm loop 34'', while a second pair of support bar mounting means 40' are spaced along legs 14'',16'' between arm loops 34'' and 28''. A rigid or semi-rigid support bar 68 is removably mounted in a pair of longitudinally aligned blind bores (not shown) in opposed mounting bosses 46', and a similar support bar 70 is mounted in aligned blind bores (not shown) in opposed mounting bosses 44'. Similarly, a pair of support bars 72,74 are positioned in aligned blind bores (not shown) in opposed mounting bosses 46', 44', respectively, of the second pair of support bar mounting means 40'.

Removably mounted on support bars 68,70,72,74 is an angle of deflection measuring means 83. Measuring means 83 comprises a pair of bracket assemblies 84,86. Bracket assembly 84 is mounted on support bars 72,74 and includes a substantially rectangular bracket 88 having a pair of U-shaped sides 90,92 facing each other. The radii of the sides 90,92 are sized to snugly receive support bars 72,74, respectively. Bracket 88 is provided with an arcuate slot 94 having a series of angle indicating marks 96 along its outer edge 97. Slot 94 has an angular extent of about 135 degrees. Bracket 88 has a hole 98 for rotatably mounting a disc-shaped marker knob 100 thereon. Mounting hole 98 is positioned at the geometric center of arcuate slot 94. A rectangular marker support arm 104 is mounted in a compatible recess (not shown) on the periphery of knob 100 and extends radially therefrom at a position adjacent one end face of the knob 100. Positioned on the periphery of knob 100 at a location spaced approximately 135 degrees in a counterclockwise direction from support arm 104 is radially aligned bore 102 whose function will be discussed later. Knob 100 is rotatably mounted on bracket 88 by mean of bolt 106 which extends through hole 98 and engages a threaded bore (not shown) in the center of knob 100. In its mounted position on bracket 88, said one end face of knob 100 is in sliding contact with the surface of bracket 88. Mounted against a pair of opposed side surfaces of marker support arm 104, respectively, are a pair of angle markers 108,110 having tapered outer ends. Each angle marker 108,110 has a threaded support post 112,118 extending from one side surface thereof, respectively, at a location intermediate their respective opposed ends. Support posts 112,118 extend through arcuate slot 94 and are secured to bracket 88 by nut 114 and washer 116, and nut 120 and washer 122, respectively. In their mounted positions on bracket 88 and support arm 104, each angle marker 108,110 spans arcuate slot 94 in a manner wherein support posts 112,118 extend through slot 94 and said opposed ends of markers 108,110 are in sliding contact with the surface of bracket 88. Accordingly, any rotation of knob 100 causes simultaneous angular movement of markers 108,110 along slot 94 wherein the tapered ends of markers 108,110 may bracket any of the angle marks 96 along edge 97 of slot 94 to indicate an angle of deflection between the upper and lower portions of the golfer's trailing arm.

A bracket assembly 86 is mounted on support bars 68,70 and includes a substantially rectangular bracket 124 having a pair of U-shaped sides 126,128 facing each other. The radii of sides 126,128 are sized to snugly receive support bars 68,70, respectively. A pair of bearing blocks 130,134 are mounted along opposite edges of bracket 124 in an aligned and parallel relationship. Bearing blocks 130,134 are provided with a pair of axially aligned, semi-circular grooves 132,136, respectively. Bearing blocks 130,134 may be composed of a polymeric material such as "TEFLON". A set of four mounting holes 138 are provided in bracket 124 at positions above and below both of the bearing blocks 130,134. A channel-shaped cover plate 140 is mounted on bracket 124 in overlying relationship with bearing blocks 130,134. Cover plate 140 is provided with a planar base member 142, a pair of parallel side members 144,146 which extend orthogonally from said base member, and a pair of flanges 150,152 which extend laterally outwardly from side members 144,146, respectively. An L-shaped slot 157 is cut through base member 142 and comprises an elongate portion 158 extending parallel to a longitudinal edge of base member 142 and a short portion 160 extending parallel to a side edge of base member 142. Each flange 150,152 is provided with a pair of mounting holes 154 (the mounting holes 154 in flange 152 are not shown). Mounting holes 154 are axially aligned with mounting holes 138 of bracket 124 to permit cover plate 140 to be secured to bracket 124 in overlying relationship with bearing blocks 130,134 using suitable fasteners such as rivets 156. Positioned in grooves 132,136 of bearing blocks 130,134, respectively, is an L-shaped actuating pin 161 having an elongate portion 162 and a connected short portion 164 which partially extends through and is positioned in slot 157. An end cap 165 is pressed onto the outer end of short portion 164. The outer end of elongate portion 162 of pin 161 is snugly pressed into radial bore 102 in knob 100. Mounted on elongate portion 162 of pin 161 is a spring 166 which is fixed in its position on elongate portion 162 by a pair of spaced C-clips 168, 170. C-clip 168 bears against one end of spring 166 and is pressed into an annular groove (not shown) in portion 162. C-clip 170 bears against the opposite end of spring 166 and is fastened against forward face 135 of bearing block 134 so that the opening of C-clip 170 is aligned with grooves 132,136 of bearing blocks 130,134 enabling bracket asembly 86, i.e. grooves 132,136, slot 157, and C-clip 170 thereof, to slide on pin 161. Bracket assemblies 84,86 are mounted on support bars 68,70,72,74 using a pair of wing bolts 172 engaged in a pair of mating threaded holes (not shown) in each U-shaped end 90,126 of brackets 88,124, respectively, see FIG. 3. After mounting on the support bars 68,70,72,74, the bracket assemblies 84,86 are adjusted laterally thereon to a starting position wherein short portion 164 of pin 161 rests against the forward end of elongate portion 158 of slot 157 and angle markers 108,110 bracket the "S" angle mark on arcuate slot edge 97 (FIGS. 3 and 4). The "S" angle mark indicates a straight condition of the golfer's trailing arm, i.e. there is no angle of deflection between the upper and lower portions of that arm. The wing bolts 172 on each bracket 88,124 are then tightened against support bars 72,68, respectively, to firmly secure them in the described position.

In use, apparatus 67 is placed on the golfer's body in the same manner as the apparatuses 10 and 39 of the first and second embodiments. During a practice swing, increased tension in strap 12", as well as the physical restraint imposed by support bars 68,70,72,74 provide learning aids for maintaining arm straightness in the same manner previously described with respect to apparatuses 10 and 39. Additionally, measuring means 83 provides a highly visible and quantitative indication of any improper angular deflection which may occur between the upper and lower portions of the golfer's trailing arm during a swing, thus enabling the golfer to effect a precise adjustment in his swing to assure arm straightness. More specifically, any improper angular lower arm movement relative to the upper portion of the golfer's trailing arm which occurs upwardly in the plane of strap legs 14", 16" results in upward angular movement of bracket assembly 86. This in turn causes clockwise rotation of pin 161, knob 100, and marker support arm 104 on bracket 88, as well as the simultaneous rotation of angle markers 108,110 along arcuate slot 94 enabling markers 108,110 to bracket the adjacent marks 96 to precisely indicate the measured angle of deviation from straightness, i.e the "S" angle mark. During this angular movement of the golfer's lower arm portion and the bracket assembly 86, bearing block grooves 132,136 slide along pin elongate portion 162, while elongate portion 158 of slot 157 in cover plate 142 slides along pin short portion 164 and spring 166 is compressed. Short portion 160 of slot 157 is provided to accommodate angles of deflection of 90 degrees or more. Return of the golfer's lower arm portion to its straight position causes spring 166 to reposition the forward end of slot elongate portion 158 against short portion 164 of pin 161.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A golf swing training apparatus comprising:

a band of elastomeric material having a pair of opposed ends, an intermediate portion between said opposed ends, said intermediate portion having a pair of opposed end points, and a pair of end portions between said intermediate portion and said opposed ends;

wherein said intermediate portion of said elastomeric band is joined at said end points to define an enlarged loop which is dimensioned to fit under an upper portion of a leading arm at an arm pit and over an adjacent shoulder of a golfer;

wherein said pair of end portions are arranged as a pair of substantially parallel legs and extend outwardly from said enlarged loop and terminate at said opposed ends of said band;

trailing hand receiving means attached to said opposed ends of said legs and said band; and a pair of trailing arm receiving means positioned between said enlarged loop and said trailing hand receiving means, each of said trailing arm receiving means being attached to said parallel legs at longitudinally spaced positions therealong;

so that, in a mounted position on a golfer, said enlarged loop fits under said leading arm at said arm pit, over an adjacent shoulder and partially across the golfer's back, a portion of said legs lies against said back while a remaining portion of said legs lies against a back surface of said trailing arm, and said trailing arm and hand are captured in said pair of trailing arm receiving means and said trailing hand receiving means, respectively.

2. The golf swing training apparatus of claim 1, wherein said band of elastomeric material is continuous.

3. The golf swing training apparatus of claim 1, wherein said band of elastomeric material is composed of a fabric.

4. The golf swing training apparatus of claim 1, wherein each of said arm receiving means comprises an annular arm loop composed of an elastomeric fabric material.

5. The golf swing training apparatus of claim 1, wherein said trailing hand receiving means is a glove.

6. The golf swing training apparatus of claim 1, further comprising trailing arm support means mounted on said parallel legs.

7. The golf swing training apparatus of claim 6, wherein said trailing arm support means comprises a first support bar mounting means positioned between said trailing hand receiving means and one of said pair of trailing arm receiving means, a second support bar mounting means positioned between said one trailing arm receiving means and the other of said trailing arm receiving means, and a third support bar mounting means positioned between said other trailing arm receiving means and said enlarged loop;

wherein said first support bar mounting means includes a first base element attached to one side of said parallel legs, a first mounting boss attached to one end of said first base element and one of said legs, said first mounting boss having a first blind bore therein, and a second mounting boss attached to an opposite end of said first base element and the other of said legs, said second mounting boss having a second blind bore therein, said first and second mounting bosses and blind bores being arranged in parallel relationship on an opposite side of said parallel legs;

wherein said second support bar mounting means includes a second base element attached to said one side of said parallel legs, a first U-shaped mounting clip attached to one end of said second base element and said one of said legs, and a second U-shaped mounting clip attached to an opposite end of said second base element and said other of said legs, said first and second U-shaped clips being arranged in parallel relationship on said opposite side of said parallel legs;

wherein said third support bar mounting means includes a third base element attached to said one side of said parallel legs, a third U-shaped mounting clip attached to one end of said third base element and said one of said legs, and a fourth U-shaped mounting clip attached to an opposite end of said third base element and said other of said legs, said third and fourth U-shaped clips being arranged in parallel relationship on said opposite side of said parallel legs;

wherein said first mounting boss, and said first and third U-shaped clips are axially aligned and longitudinally spaced on said one leg, and said second mounting boss, and said second and fourth U-shaped clips are axially aligned and longitudinally spaced on said other of said legs; and said trailing arm support means further comprises a first support bar removably mounted in said first blind bore, and said first and said third U-shaped clips, and a second support bar removably mounted in said second blind bore, and said second and said fourth U-shaped clips.

8. The golf swing training apparatus of claim 7, wherein said first and second support bars are composed of a polymeric material.

9. The golf swing training apparatus of claim 7, wherein said first and second support bars are composed of aluminum rod.

10. The golf swing training apparatus of claim 6, further comprising angle of deflection measuring means mounted on said trailing arm support means.

11. The golf swing training apparatus of claim 10, wherein said trailing arm support means comprises fourth and fifth support bar mounting means positioned between said trailing hand receiving means and one of said pair of trailing arm receiving means, and a sixth and seventh support bar mounting means positioned between said one and said other of said trailing arm receiving means;

wherein said fourth support bar mounting means includes a fourth base element attached to one side of said parallel legs, a third mounting boss attached to one end of said fourth base element and one of said legs, said third mounting boss having a third blind bore therein, and a fourth mounting boss attached to an opposite end of said fourth base element and the other of said legs, said fourth mounting boss having a fourth blind bore therein, said third and fourth mounting bosses and blind bores being arranged in parallel relationship on an opposite side of said parallel legs;

wherein said fifth support bar mounting means includes a fifth base element attached to said one side of said parallel legs, a fifth mounting boss attached to one end of said fifth base element and said one of said legs, said fifth mounting boss having a fifth blind bore therein, and a sixth mounting boss attached to an opposite end of said fifth base element and said other of said legs, said sixth mounting boss having a sixth blind bore therein, said fifth and sixth mounting bosses and blind bores being arranged in parallel relationship on said opposite side of said parallel legs;

wherein said third and fifth mounting bosses and blind bores are axially aligned and longitudinally spaced on said one leg, and said fourth and sixth mounting bosses and blind bores are axially aligned and longitudinally spaced on said other of said legs;

a third support bar removably mounted in said third and fifth blind bores, and a fourth support bar removably mounted in said fourth and sixth blind bores;

wherein said sixth support bar mounting means includes a sixth base element attached to said one side of said parallel legs, a seventh mounting boss attached to one end of said sixth base element and said one of said legs, said seventh mounting boss having a seventh blind bore therein, and an eighth mounting boss attached to an opposite end of said sixth base element and said other of said legs, said eighth mounting boss having an eighth blind bore therein, said seventh and eighth mounting bosses and blind bores being arranged in parallel relationship on said opposite side of said parallel legs;

wherein said seventh support bar mounting means includes a seventh base element attached to said one side of said parallel legs, a ninth mounting boss attached to one end of said seventh base element and said one of said legs, said ninth mounting boss having a ninth blind bore therein, and a tenth mounting boss attached to an opposite end of said seventh base element and said other of said legs, said tenth mounting boss having a tenth blind bore therein, said ninth and tenth mounting bosses and blind bores being arranged in parallel relationship on said opposite side of said parallel legs;

wherein said third, fifth, seventh, and ninth mounting bosses and blind bores are axially aligned and longitudinally spaced on said one leg, and said fourth, sixth, eighth, and tenth mounting bosses and blind bores are axially aligned and longitudinally spaced on said other of said legs; and said trailing arm support means further comprises a third support bar removably mounted in said third and fifth blind bores, a fourth support bar removably mounted in said fourth and sixth blind bores, a fifth support bar removably mounted in said seventh and ninth blind bores, and a sixth support bar removably mounted in said eighth and tenth blind bores.

12. The golf swing training apparatus of claim 11, wherein said angle of deflection measuring means comprises a first bracket assembly which includes a substantially rectangular first bracket, said first bracket having a pair of opposed and facing first U-shaped sides and a first planar portion extending between said first U-shaped sides, one of said first U-shaped sides being mounted on said fifth support bar and the other of said first U-shaped sides being mounted on said sixth support bar, first fastener means mounted on and extending through said one of said first U-shaped sides and bearing against said fifth support bar to secure said first bracket in a fixed longitudinal position on said fifth and sixth support bars, an arcuate slot extending through said first planar portion of said first bracket, a series of angle indicating marks positioned along an edge of said arcuate slot, a mounting hole extending through said first planar portion, said mounting hole being positioned at the geometric center of said arcuate slot, a disc-shaped marker knob, first fastener means extending through said mounting hole and secured to said marker knob for rotatably fixing said marker knob in sliding contact with said first planar portion in a position adjacent said arcuate slot, a pin receiving hole positioned on the periphery of said marker knob and extending radially into said marker knob, a marker support arm mounted on the periphery of said marker knob and spaced circumferentially from said pin receiving hole, said marker support arm extending radially outwardly from the periphery of said marker knob in a position adjacent said arcuate slot, said marker support arm having a pair of opposed mounting surfaces, an angle marker secured on each opposed mounting surface in sliding contact with said planar portion, said angle markers spanning said arcuate slot, each angle marker comprising a tapered portion on one end which overlies said angle indicating marks along said edge of said arcuate slot, a threaded support post which extends from a middle portion and through said arcuate slot, and an opposed end portion which overlies an opposite edge of said arcuate slot, and third fastening means engaging said threaded support posts for securing said angle markers to said marker support arm; and a second bracket assembly which includes a substantially rectangular second bracket, said second bracket having a pair of opposed and facing second U-shaped sides and a second planar portion extending between said second U-shaped sides, one of said second U-shaped sides being mounted on said third support bar and the other of said second U-shaped sides being mounted on said fourth support bar, fourth fastener means mounted on and extending through said one of said second U-shaped sides and bearing against said third support bar to secure said second bracket in a fixed longitudinal position on said third and fourth support bars, a pair of bearing blocks mounted on said second planar portion, each of said bearing blocks having a semi-circular groove therein, said bearing blocks being mounted in parallel relationship adjacent respective opposed edges of said second planar portion wherein said semi-circular grooves are axially aligned, a channel-shaped cover plate mounted on said second planar portion in overlying relationship with said bearing blocks, said cover plate having a planar base member and an L-shaped slot extending through said planar base member, fifth fastener means for securing said cover plate to said second planar portion, an L-shaped marker knob actuating pin, said actuating pin having an elongate portion positioned in said semi-circular grooves for relative sliding movement therein, and a short portion positioned in said L-shaped slot for relative sliding movement therein, said elongate portion of said actuating pin having an end portion pressed into said pin receiving hole of said disc-shaped marker knob, and a spring mounted on a section of said elongate portion of said L-shaped actuating pin, said spring having one end fixed on said section by a first C-clip secured to said section, and an opposed end positioned against a second C-clip fastened against a forward face of one of said bearing blocks in a manner wherein the opening of said second C-clip and said semi-circular grooves of said pair of bearing blocks are axially aligned enabling said pair of bearing blocks and said second C-clip to slide on said actuating pin.

* * * * *